United States Patent [19]

Seibert

[11] 4,165,052

[45] Aug. 21, 1979

[54] APPARATUS FOR WINDING OR UNWINDING OF A CORD-SHAPED WINDING MATERIAL

[75] Inventor: Gerhard Seibert, Vienna, Austria

[73] Assignee: Rosendahl Industrie-Handels AG, Schonenwerd, Switzerland

[21] Appl. No.: 892,962

[22] Filed: Apr. 3, 1978

[30] Foreign Application Priority Data

Nov. 26, 1977 [DE] Fed. Rep. of Germany ..... 2752817

[51] Int. Cl.[2] ..... B21C 47/02; B21C 47/24

[52] U.S. Cl. ..... 242/78.1; 242/79

[58] Field of Search ..... 242/79, 86.8, 78.1, 242/78.6, 78.8, 82, 58.6, 67.1 R, 86.52, 86.58; 294/1 Q, 1 BC

[56] References Cited

U.S. PATENT DOCUMENTS

| | | | |
|---|---|---|---|
| 1,088,039 | 2/1914 | Salmon | 242/78.1 |
| 2,801,057 | 7/1957 | Rayburn | 242/79 X |
| 2,962,241 | 11/1960 | Campbell | 242/79 |
| 3,598,333 | 8/1971 | Beeman | 242/78.1 |

*Primary Examiner*—Edward J. McCarthy

*Attorney, Agent, or Firm*—Martin A. Farber

[57] ABSTRACT

A device for winding or unwinding of a cord-shaped material on and off a spool, respectively, with a spool support unit comprising two adjustable sleeves and a drive mechanism for rotating the spool, and with the spool support unit being suspended on a carrier. The support unit is mounted on the carrier rotatable out of its operating position by at least 90° around a vertical axis.

16 Claims, 19 Drawing Figures

FIG. 1
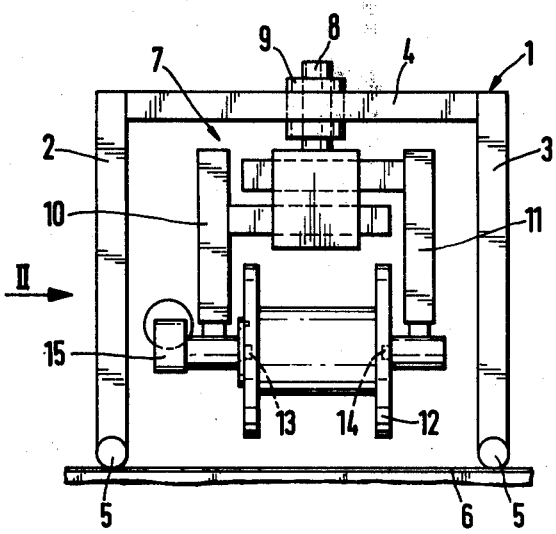
FIG. 2
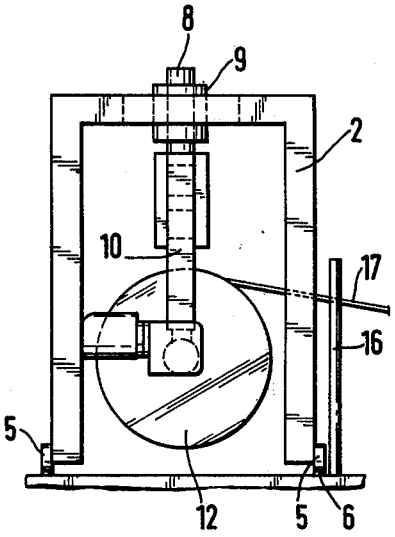
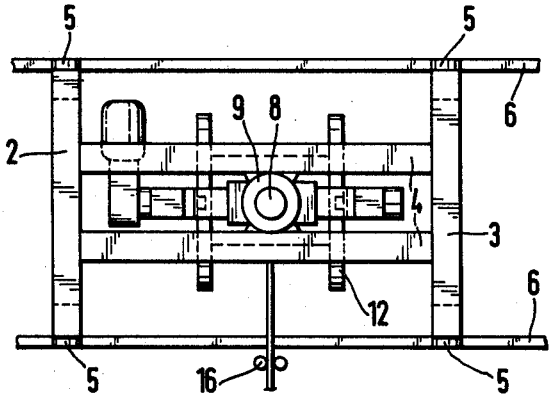
FIG. 3

FIG. 4
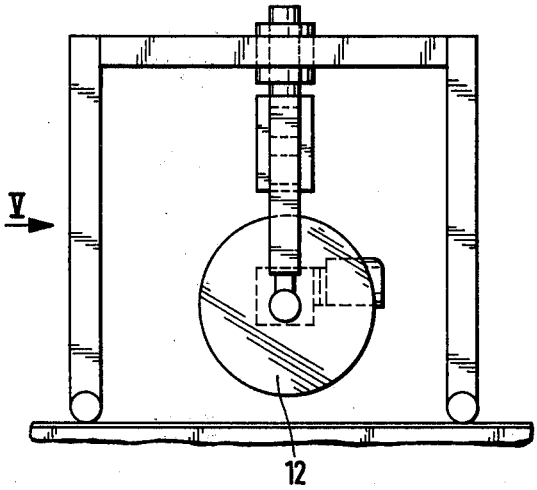
FIG. 5
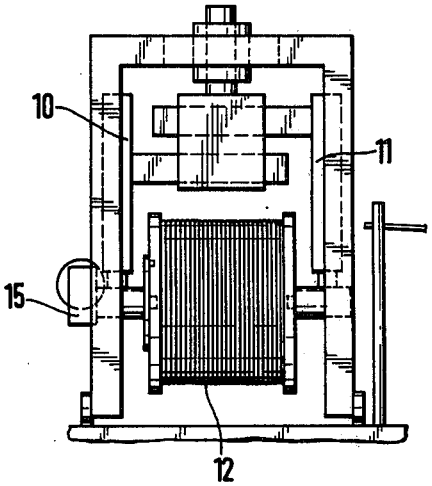
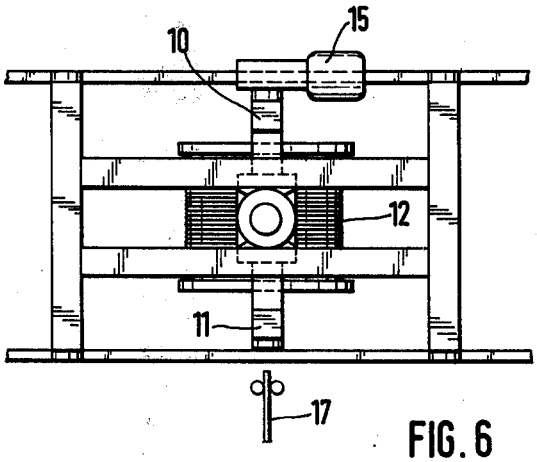
FIG. 6

20
21
18
19

20
21
7

20
21

20
21
18

5
7
22
23
24
25
26
28
29

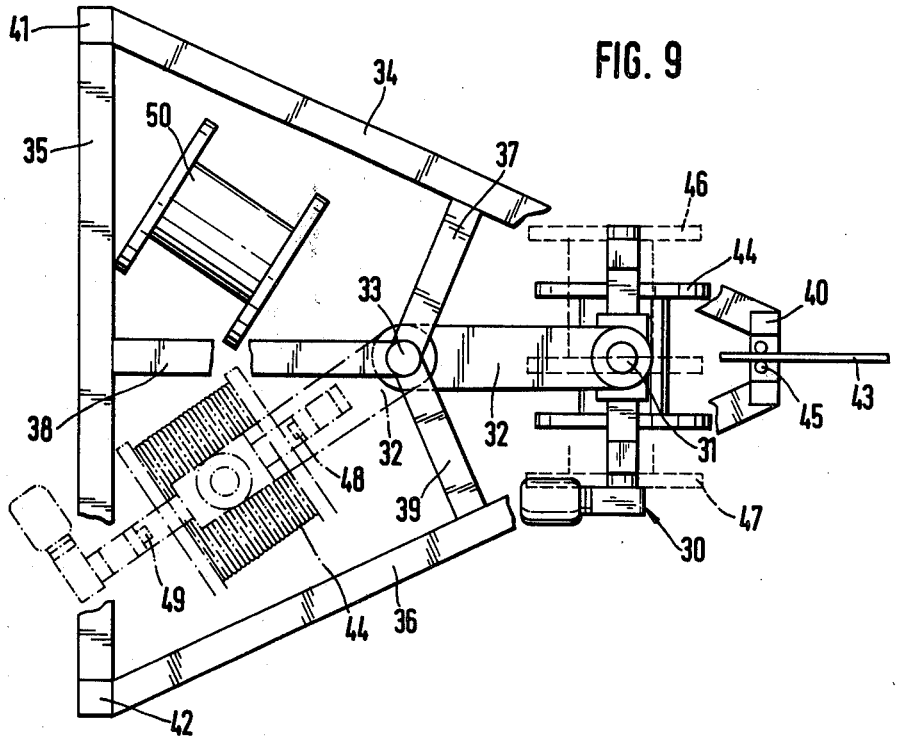
FIG. 9
FIG. 10
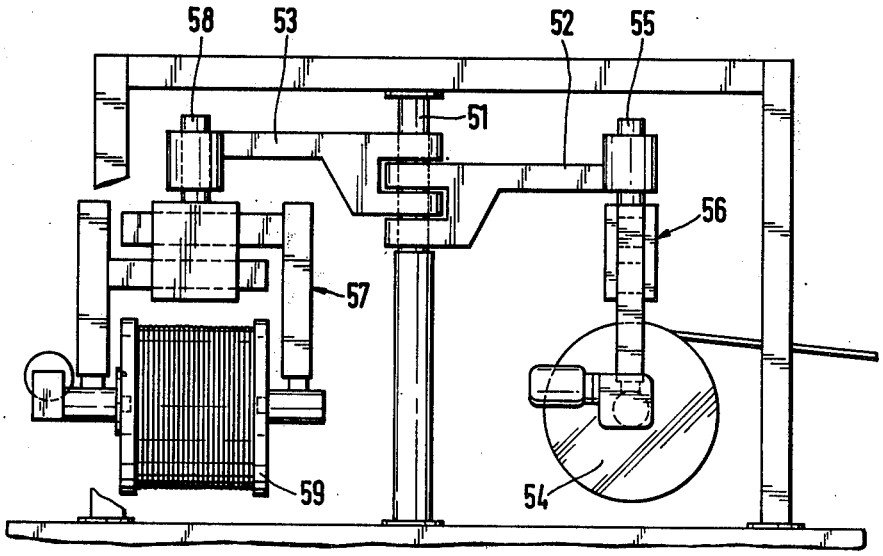

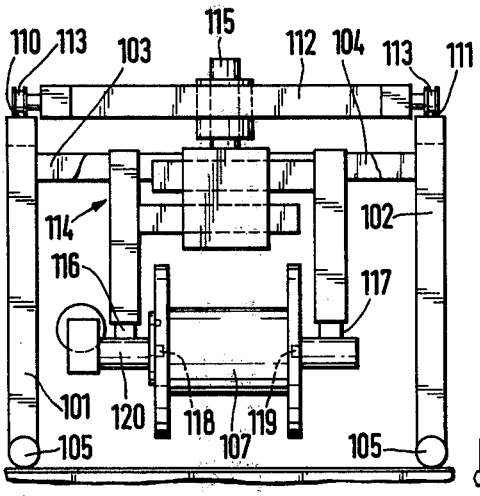
FIG. 11
FIG. 12
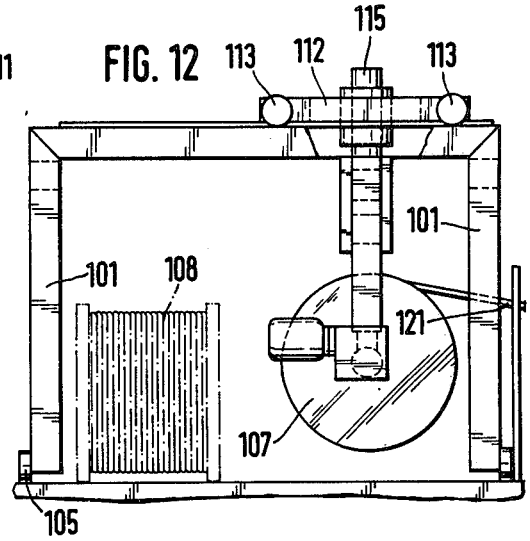
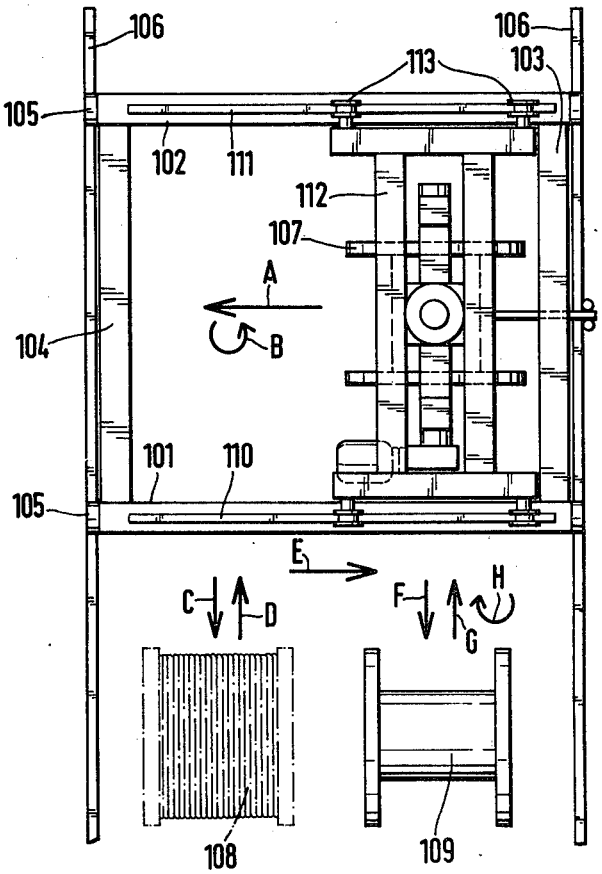
FIG. 13

APPARATUS FOR WINDING OR UNWINDING OF A CORD-SHAPED WINDING MATERIAL

The invention relates to a device for winding or unwinding a cord-shaped material, e.g., an electric cable or a steel cable or rope, on and off a spool drum, respectively, with a spool holder or mounting support unit, the latter having two adjustable sleeves and a drive mechanism for rotating the spool, the spool support being suspended on a carrier or support.

Devices of this type are used particularly when the material, which is to be wound and unwound, respectively, on and off of spools of appropriate diameter, is of large diameter. Spools of this order of magnitude may weigh several tons when fully wound. According to conventional practice it is generally not possible to directly receive such drums, for example, with a fork-lift vehicle.

Empty spools which are to be wound are brought to the winding machine by wheelbarrow, cart or crane and deposited on the floor. The spool is then rolled on the floor up to a position where the sleeves of the device can receive the spool, and the mounting or support unit with the spool can be moved into the winding position. When the spool is fully wound the full spool is again lowered to the floor, at which time the sleeves are disengaged from the flanges of the spool to release the latter. The heavy spool must now be rolled out of the machine up to a point where it can be received or picked up by a transporting means. If the device is used to unwind a spool, correspondingly then the loaded spool must be rolled-in and the empty spool must be rolled out from the machine.

This rolling of the spool drums on the shop floor presents many hazardous moments for men and machine. Great effort must be applied to get a spool, weighing several tons under the circumstances, rolling and steered in the proper direction to its designated position. Also correspondingly great forces must be expended to bring the spool to a stop.

A further serious disadvantage of these devices lies in the fact that the winding process is interrupted for a relatively long time during a changing of the spools or drums. So as not to further increase this loss of time in changing the drums it is necessary to have, e.g., a crane or fork-lift available on standby, thus taking them away from some other work which they might do in the meanwhile.

It is an object of this invention to provide a device for winding or unwinding a cord-shaped windable material, which increases the safety of the winding area, is able to reduce the work forces which are required and which reduces the time required for changing the spools or drums to a minimum.

It is another object of the present invention to aid in the solution of the above object in the manner that the spool holder or mounting unit (7) when out of its operating position is rotatably mounted on a carrier (4) rotatable by at least 90° around a vertical axle (8). By these measures new, safer operating methods for bringing in and removing the spools from the winding device are made possible.

For example now with a laterally open device, after a wound spool is deposited on the floor and the spool holding sleeves are released, the complete mounting unit with the sleeves (which sleeves have moved correspondingly far apart from one another) can be rotated 90° about its vertical axle, so far that the spool on one or both front sides is freely accessible for a wheelbarrow. After the spool or drum has been received by the transporting means, it can be delivered from the machine without having to contend with parts of the device providing obstructions in the path. This same is true when an empty spool is to be fed into the machine.

If, on the other hand, the device is accessible only perpendicularly to the axis of rotation of the spool which is disposed in the operating position, for e.g. a wheelbarrow means, then the mounting unit together with the spool or drum is first rotated around its vertical axis by 90°. Then the spool is deposited on the floor. After turning the mounting unit back into its operating position, the spool again is now accessible on the front side for a wheelbarrow, so that the spool changing can be performed rapidly without having to roll the spool on the floor.

According to a preferred embodiment of the invention the carrier or beam (4) is moveable on floor rails, framework rails or overhead or ceiling rails (18) toward each side, respectively by the complete width of the device, in that direction of the axis of the sleeves (13, 14) of the spool support unit (7) when the latter is disposed in the operating position, whereby in the case of a beam or carrier arranged on a frame, the latter being moveable on the side of the floor, then the frame on both front or face sides thereof respectively has an opening sufficiently wide to permit the frame to travel over a spool which has been set on the floor.

This arrangement of the device offers the great advantage that the spools can be changed at a time that is independent of the availability of a transportation means.

The device is moveable on its rails toward each side from the operating position so far that a spool can be set down (deposited), or an available spool can be received. After the device has been moved back to its operating position it can perform the next winding or unwinding operation while the previously set down spool can be taken away and a new spool can be engaged.

In a further advantageous embodiment of this invention the carrier or beam (4) is moveable from the operating position in two horizontal directions which are perpendicular to each other, on floor rails, framework rails or overhead rails (23, 24), each respectively for a distance approximately equal to the width of the device in the direction of the rails under the circumstances, whereby in the case of a beam arranged on a frame, the latter being moveable on the side of the floor, then the frame on advancing face sides has an opening sufficiently wide to permit the frame to travel over a spool which has been deposited on the floor.

A movement of the device is provided in two horizontal directions perpendicular to each other when the available work area in a shop does not permit using the previously manner of operation.

A further advantageous embodiment is that the spool carrier (32) constitutes a cantilever arm which is mounted rotatably on a vertical column (33) by 360°, and the spool support unit (30) is rotatably mounted on the free end of the cantilever arm.

This type of mounting of the spool support unit on the one hand saves a lot of space, since only a circular area must be kept clear for the working operation and disturbing rails are eliminated; on the other hand, it saves time, since the paths which are traversed by the device without a spool is very small.

In further development of this invention two carriers (52, 53) each with one spool support unit (56, 57) are mounted rotatably independent from each other on the vertical column (51). By this the winding efficiency or productivity of the device can be considerably increased, since during the spool change the feeding and removal of the winding material is only interrupted for very short times.

In a further embodiment of this invention, the vertical column (33) is supported on its upper end on a cover or a framework.

The device according to this invention for the winding or unwinding of a windable material can also use a winder with a self-laying means for laying the windable material on the spool, that is, with a back and forth movement of the device in the axial direction of the spool during the winding operation, as well as also without a self-laying unit i.e., laying the windable material on a spacially stationary drum by means of a laying guide which moves back and forth, that is such a laying guide oscillates back and forth while the spool remains stationary.

With the above and other objects and advantages in view, the present invention will become more clearly understood in connection with the following detailed description of preferred embodiments, when considered with the accompanying drawings, of which:

FIG. 1 is an elevational view of a device for winding and unwinding of cable or the like with a two column framework shown in its operating position, viewed from the feed direction of the cable;

FIG. 2 is a side view of FIG. 1 viewed in the direction indicated by arrow II;

FIG. 3 is a top plan view of the apparatus of FIG. 1;

FIG. 4 is a side view of the apparatus of FIG. 1 with the spool support unit rotated 90°;

FIG. 5 is a side view of the apparatus of FIG. 4 viewed in the side direction indicated by the arrow V;

FIG. 6 is a top plan view of the apparatus of FIG. 4;

Figures 7, 7A, 7B, 7C, 7D:
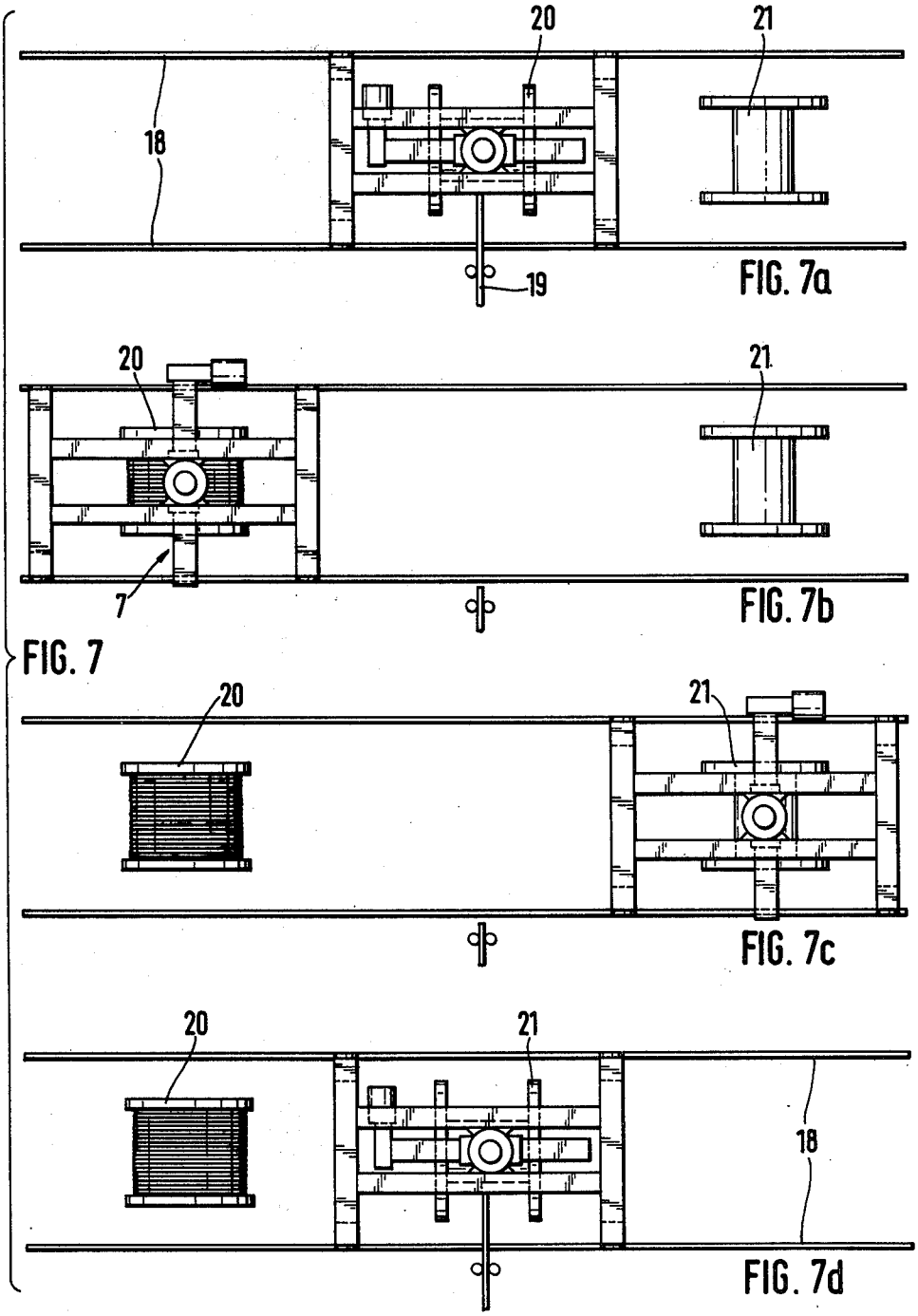

FIGS. 7*a–d* are schematic top plan views illustrating the operating sequence of an apparatus for winding and unwinding which can be moved to both front sides of its operating position;

FIGS. 8*a–d* are schematic diagrams indicating the operating sequence of a device which can be rolled in one or another path disposed perpendicularly with respect to each other;

FIG. 9 is a top plan view of a device for winding and unwinding, respectively, in which a cantilever carrier is supported on a vertical column about which it is rotatable;

FIG. 10 is a side elevational view of a device for winding and unwinding, respectively, with two carrier arms independent from each other which are rotatably mounted around one column, each carrier arm having respectively one spool support unit;

FIG. 11 is an elevational view of a device for winding and unwinding, respectively, a cable or the like with a framework moveable on a pair of floor rails and a spool carriage moveable on rails on the framework, the device being shown in its operating position;

FIG. 12 is a side view of the device of FIG. 11; and

FIG. 13 is a top plan view of the device according to FIG. 11.

FIG. 1 shows a device for winding or unwinding a windable material. This device includes on the front side a two column framework 1 which is moveable on rails located on the floor. The two column framework comprises two vertical frames 2 and 3 which are open at the front side and which are rigidly connected to each other by horizontal beams 4 on their upper cross beams. This entire framework is provided with lateral outer wheels 5 on the lower ends thereof, which wheels ride on the rails 6, the wheels being actuated by a motor (not shown) mounted on the two column framework. About halfway between the frames 2 and 3 on the horizontal beams 4, a spool support 7 is mounted with a vertical pivot pin 8 in a pivot mounting or bogie 9, the latter being mounted on the beams 4. Two arms 10 and 11 which are adjustable independently from each other in the horizontal and vertical directions are guided on the mounting 7, the arms on their lower ends having sleeves or pintels 13 and 14 which serve to receive and engage the spool 12. The sleeve 13 is connected with a rotational drive 15 which provides the necessary turning of the spool for the winding. FIG. 2 shows a counterclockwise rotating spool 12 with the cable 17 introduced through a guide arrangement 16.

When the spool 12 is fully loaded or wound, then the loaded spool together with the mounting can be rotated 90° into the position shown in FIGS. 4–6, in which the spool hubs or flanges lie parallel to the larger gate or column opening of frame 1. After setting the loaded spool down and turning the mounting 7 back to its operating position according to FIG. 1, the spool 12 can be conveniently or easily removed from the device e.g., by a stacker truck and can be replaced by an empty spool.

However this manner of operation requires that a transportation means be made available at all times to expedite the changing of spools. One becomes independent of the transportation means if one sets the device according to FIGS. 1–6 on sufficiently long rails 18 as shown in FIGS. 7*a–d*.

In FIGS. 7*a–d*, the floor rails 18 are about three times the length of the device. In its working position, the device is substantially located on the rails in the center of the rails (FIG. 7*a*), and winds the cable 19, which is fed from the front, onto the spool 20. To the right adjacent the device, an empty spool 21 is placed inside the free ends of rails with its flanges parallel to the rails. When the spool 20 is fully wound, the feeding of the cable 19 is interrupted and the device is rolled to the left by a distance approximately equal to the width of the device. Here the support unit is rotated 90° and the loaded spool 20 is placed on the floor and the spool is released from the support 7 (FIG. 7*b*). The device is then rolled to the right unit the axis of the sleeves are in alignment with the axis of the empty spool 21, at which time the spool 21 is received and picked up by the support unit 7 (FIG. 7*c*). Now the device travels back to its working or operating position, the support unit 7 is rotated 90° with the empty spool 21 until the spool axis is perpendicular to the cable 19 which is to be fed (FIG. 7(*d*)). While the drum or spool 21 is being wound, the loaded spool 20 can opportunely be removed by a transportation means and an empty spool can be placed preparatory to the next spool change. For this mode of operation it is a self-evident requirement that the lateral U-shaped frames 2, 3 of the two column framework are sufficiently wide apart to allow the device to pass over a spool which is deposited on the floor.

Figures 8, 8A, 8B, 8C, 8D:
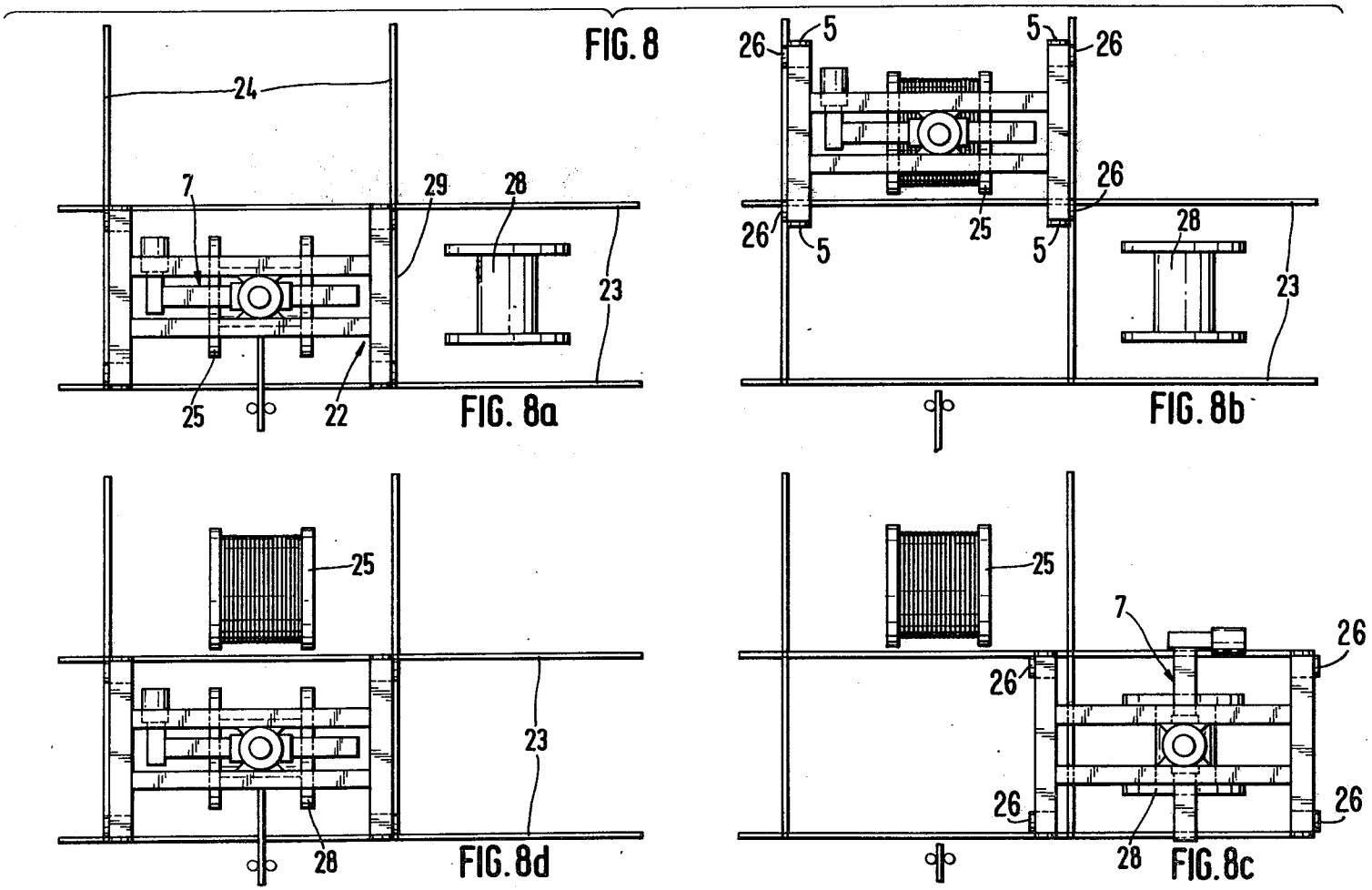

In FIG. 8 the device is so designed as to permit movement on two rails 23 and 24, which are positioned at right angles to each other. When the drum or spool 25 is fully loaded, the entire device is moved to the rear on the rails 24 until the spool 25 is outside of the path of the rails 23 and between the rails 24, where it can be deposited on the floor (FIG. 8*b*). Then the empty device is moved into the rails 23 where the support unit 7 is rotated 90° in order to pick up the empty spool 28 which has been placed inside and parallel to the rails 23. Here the opening of the front side 29 of the device should be sufficient to permit the device to pass over the spool 28 (FIG. 8*c*). After the support unit 7 has picked up the spool 28 and has been rotated 90°, the support unit 7 is moved to its operating position and the winding operation can be continued on the spool 28. In the meantime the loaded spool 25 can be removed and a new empty spool made available between the rails 23. With the embodiment as described in FIG. 8, the two column framework also includes a set of retractable wheels 26 with a coordinated drive course, the latter mentioned wheels being positioned perpendicularly to the wheels 5 and being powered, which mechanism therefor is not shown further in the schematic drawings.

FIG. 9 shows a device for winding or unwinding a windable material, by which the spool support unit 30 is rotatably suspended with its spindle or pivot pin 31 on one end of a carrier 32 which is formed as a cantilever beam 32, which carrier 32 in turn is rotatably supported with its other end on a vertical column 33. The upper end of the vertical column 33 is mounted in position by a triangular frame, the latter by means of the horizontal beams 34, 35, 36, 37, 38 and 39 transmitting the stresses to the floor through the vertical supports or columns 40, 41 and 42.

If the device is conceived as having a self-laying mechanism, the winding-on cable 43 can be laid on the spool drum 44 by oscillating the cantilever carrier arm 32 back and forth. The stationary laying guide rollers 45 serve as laying guides and assure proper laying of the windable material. During the winding operation and while the spool 44 is being oscillated back and forth for the purpose of obtaining proper laying of the windable material onto the spool drum 44, the axis of the spool must at all times be held perpendicularly to the direction of feed of the material being wound. The end positions 46, 47 of the oscillating spool 44 are represented by dot-dashed lines.

When the spool 44 is fully loaded, the spool suspension unit 30 and the cantilever arm 32 are rotated back 90° to 180° around the vertical column 33 by a drive motor (not illustrated), which motor is attached to the cantilever arm 32 or to the vertical column 33. This motor can simultaneously form the changeable drive during the winding operation. Another rotational drive motor for the spindle pin 31 assures that the spool support unit 30 with its spool 44 can be rotated so that the spool axis is aligned parallel to the axis of the cantilever arm 32.

The rotated position of the cantilever arm 32, the support unit 30 and the spool 44 is indicated by dot-dashed broken lines. In this position the loaded spool 44 is lowered and deposited on the floor and released from the support unit 30 by moving the sleeves 48 and 49 to their widest opening apart from each other. The support unit 30 can now be swung out on its pivot arm 32 to pick up an empty spool 50 which has been placed there with its longitudinal axis in radial alignment to the vertical column 33, the middle of the longitudinal axis thereof being disposed on a circular arc having a radius substantially equal to the length of the cantilever arm 32.

The spool support unit 30 with the spool 50 is now rotated 90° so that the longitudinal axis of the spool is perpendicular to the axis of the cantilever arm 32. Thereafter the cantilever arm 32 with the spool support unit 30 and the spool are rotated around column 33 into the operating position and the winding operation can again be resumed. The loaded spool 44 in the meantime would be taken away by a transportation device and a new empty spool put in its place.

FIG. 10 shows a vertical column 51 which supports two cantilever arms 52 and 53 which are independently rotatably mounted around the column 51. Each arm is formed with two spaced fork-like bearing portions which are disposed between th fork-like bearing portions of the other arm, the bearing portions rotatably mounting the arms on the column 51. A spool 54 is suspended on a spool support unit 56 in the operating position, the support unit 56 being rotatably mounted around a journal or pivot pin 55. On the cantilever beam or arm 53 which is pivoted away from the operating position there is rotatably mounted a support unit 57, which has been rotated 90° around its vertical journal or pivot pin 58, so that the axis of rotation of the completely wound spool 59 extends radially with respect to the vertical column 51. The spool 59 is deposited on the floor and an empty spool which has been placed available in position radial to the column 51 in the pivoting range of the cantilever arm 53, is picked up by the support unit 57. After the latter is rotated back 90° around its vertical spindle 58, the axis of rotation of the supported empty spool extends perpendicularly to the axis of the cantilever arm 53, and the winding unit 53, 57 stands ready and prepared for a new winding operation.

The loaded spool 59 is removed in the meantime and replaced by an empty spool. As soon as the spool 54 is completely wound, the cantilever arm 52 is pivoted out of the operating position, with simultaneous pivoting of the cantilever arm 53 into the winding position. The winding operation is consequently interrupted only for a very short time. While the spool in one winding assembly is winding, on the other winding assembly a spool exchange takes place in preparation for the next operation.

FIG. 11 shows a two column framework for the device comprising frames 101 and 102 which are U-shaped on the front side and which are rigidly connected together on their frame corners by lateral longitudinal beams 103, 104 at the upper ends of the frames 101, 102. The base or lower portion of the frame members are provided with wheels 105, which permit the entire framework to be rolled on floor rails 106 in a direction parallel to the axis of a spool 107 which is located in the operating position. The front or face side opening in the two column framework and the open interior width of the U-frames 101, 102, respectively, are selected so as to permit them to pass over two spools 108, 109 which have been placed on the floor with their flanges parallel to the floor rails and in ranked or spaced distance from each other.

Rails 110, 111 are mounted on the upper side of the horizontal cross-beams of the frames 101, 102, on which rails a carrier which is formed as a carriage 112 is supported by means of wheels 113. Approximately in the middle of this carriage 112, a spool support unit 114 is rotatably mounted by means of a vertical journal or pivot 115. The free ends of arms 116, 117 carry sleeves 118 and 119, which sleeves serve to receive a spool 107. The arms 116 and 117 are telescopically adjustable in height and width, i.e., vertically and horizontally. The sleeve 118 is connected with a rotating drive (not illustrated).

FIGS. 11, 12, and 13 respectively illustrate the operating procedure as follows: When the spool 107 is fully wound, the feed of the cable 121 is interrupted. The carriage 112 is rolled on the rails 110, 111 up to the rearward end of the frames 101, 102 (see arrow A in FIG. 13).

The spool support unit 114 which is rotatably mounted on the carriage 112 is now rotated 90° so that the flanges of the spool 107 are directed parallel to the rails 106 (see arrow B).

The framework is now rolled on the rails 106 (see arrow C) until it can deposit the spool 107 on the floor which has been kept free at the left adjacent the device, as seen looking at the device from the cable-feed site, where space has been provided for the retention of the spool 107, comparing the completely loaded spool 108 shown in dot-dashed lines. After depositing the loaded spool 107 and releasing of the sleeves 118, 119 (which hold the spool), the device is rolled back (see arrow D) so far in the direction towards its operating position until the support arms 116, 117 can pass by the spool 108. Thereafter the carriage 112 is moved on its rails 110 and 111 via wheels 113 in a direction towards the front side of the device (see arrow E) sufficiently far until the sleeves 118, 119 on the flanges can pass by the empty spool 109 which stands in the waiting position, after which the entire device can be rolled on its bottom rails 106 in the direction of the arrow F to the empty spool 109. After the spool 109 has been picked up by the support unit 114 the entire device is moved back to its operating position (arrow G). On this course the support unit 114 is rotated 90° (see arrow H) so that the spool axis is parallel to the rails 106, and the winding operation can be continued. A transportation means in the meantime can move the loaded spool 108 away and replace it with a new empty spool in preparation for the next spool change. Also here motor drives (not shown) are provided for this arrangement for the two directions.

In accordance with the invention, the journals 8, 31, 55, 58 or 115 can be rotated relative to the mounting 9 or the like in the other figures, or instead the journals can be fixed therein and the member which holds the horizontal extensions of the arms 10 and 11 can be rotated relative to the journals. The rotation in either case can be driven by a drive means not shown.

While I have disclosed several embodiments of the present invention it is to be understood that they are given by example only and not in a limiting sense.

I claim:

1. A device for winding and unwinding a cord-shaped material, such as a cable, on and off a spool, respectively, with a spool support unit having two adjustable sleeves for holding the spool and a drive mechanism for rotating the spool, and with a carrier on which the spool support unit is suspended, comprising a carrier, at least one spool support unit mounted on said carrier and defining an operating position, means for rotating said spool support unit by at least 90° about a vertical axis out of said operating position.

2. The device as set forth in claim 1, further comprising rails, said carrier is at least moveably disposed on said rails toward each side, respectively, by at least the complete width of the device in a direction defined by the axis of the sleeves of the spool support unit when the latter is disposed in said operating position.

3. The device as set forth in claim 2, wherein said rails are floor rails.

4. The device as set forth in claim 3, further comprising a framework directly moveably disposed on said floor rails, said carrier comprises at least one beam mounted on said framework, said framework defines two face sides respectively forming an opening wider than a spool, whereby the framework can travel over a spool deposited on the floor between said floor rails.

5. The device as set forth in claim 2, further comprising a framework, said rails are mounted on said framework, said carrier is directly moveably mounted on said rails.

6. The device as set forth in claim 2, wherein said rails are overhead rails, said carrier is directly moveably mounted on said overhead rails.

7. The device as set forth in claim 1, further comprising horizontal rails disposed perpendicularly to each other, said carrier is at least moveably disposed on said rails by a distance approximately equal to the width of the device in the respective direction of said rails out of said operating position in two horizontal directions perpendicular to each other, respectively.

8. The device as set forth in claim 7, wherein said rails are floor rails.

9. The device as set forth in claim 7, further comprising a framework directly moveably disposed on said floor rails, said carrier comprises at least one beam mounted on said framework, said framework defines two face sides respectively forming an opening wider than a spool, whereby the framework can travel over a spool deposited on the floor between said floor rails.

10. The device as set forth in claim 7, further comprising a framework, said rails are mounted on said framework, said carrier is directly moveably disposed on said rails.

11. The device as set forth in claim 7, wherein said rails are overhead rails, said carrier is directly moveably disposed on said overhead rails.

12. The device as set forth in claim 7, wherein said horizontal rails comprise floor rails and framework rails, said floor rails are disposed perpendicularly to a cable running direction, a framework moveably disposed on said floor rails perpendicularly to the cable running direction, said framework rails are mounted on said framework and extend parallel to said cable running direction, said carrier comprises a carriage moveably disposed on said framework rails parallel to said cable running direction.

13. The device as set forth in claim 1, further comprising a vertical column, said carrier constitutes at least one cantilever arm rotatably mounted on said vertical column by 360°, said cantilever arm has a free end, said spool support unit is rotatably mounted on said free end of said cantilever arm.

14. The device as set forth in claim 13, wherein said at least one support unit comprises two support units, said carrier constitutes two arms rotatably mounted on said vertical column, respectively, one of said two spool support units, respectively, is mounted rotatably independently from the other of said two support units on each of said arms, respectively.

15. The device as set forth in claim 13, further comprising cover means for supporting an upper end of said vertical column.

16. The device as set forth in claim 13, further comprising a framework, said vertical column has an upper end supported on said framework.

* * * * *